US009186549B2

(12) United States Patent
Watterson et al.

(10) Patent No.: US 9,186,549 B2
(45) Date of Patent: Nov. 17, 2015

(54) SYSTEMS, METHODS, AND DEVICES FOR GATHERING AND TRANSMITTING EXERCISE RELATED DATA

(71) Applicant: ICON Health & Fitness, Inc., Logan, UT (US)

(72) Inventors: Scott R. Watterson, Logan, UT (US); Mark D. Watterson, Logan, UT (US); David Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 206 days.

(21) Appl. No.: 13/856,336

(22) Filed: Apr. 3, 2013

(65) Prior Publication Data

US 2013/0267385 A1 Oct. 10, 2013

Related U.S. Application Data

(60) Provisional application No. 61/620,099, filed on Apr. 4, 2012.

(51) Int. Cl.

| | |
|---|---|
| ***A63B 71/00*** | (2006.01) |
| ***A63B 22/02*** | (2006.01) |
| ***A63B 24/00*** | (2006.01) |
| *A63B 71/06* | (2006.01) |

(52) U.S. Cl.

CPC ..... *A63B 24/0062* (2013.01); *A63B 22/02* (2013.01); *A63B 71/0622* (2013.01); *A63B 2071/0638* (2013.01); *A63B 2209/08* (2013.01); *A63B 2209/10* (2013.01); *A63B 2220/17* (2013.01); *A63B 2220/18* (2013.01); *A63B 2225/055* (2013.01); *A63B 2225/20* (2013.01); *A63B 2225/50* (2013.01)

(58) Field of Classification Search

CPC ..... A63B 24/0062; A63B 22/02; A63B 2225/055; A63B 71/0622; A63B 2209/10; A63B 2225/50; A63B 2220/17; A63B 2220/18; A63B 2071/0638; A63B 2209/08; A63B 2225/20; A63B 71/06

USPC ..... 482/8; 73/510, 670

See application file for complete search history.

(56) References Cited

U.S. PATENT DOCUMENTS

| | | | | |
|---|---|---|---|---|
| 5,314,391 | A * | 5/1994 | Potash et al. | 482/7 |
| 6,458,060 | B1 | 10/2002 | Watterson et al. | |
| 6,513,381 | B2 * | 2/2003 | Fyfe et al. | 73/510 |
| 7,060,006 | B1 | 6/2006 | Watterson et al. | |
| 7,166,062 | B1 | 1/2007 | Watterson et al. | |
| 7,455,622 | B2 | 11/2008 | Watterson et al. | |
| 7,507,187 | B2 * | 3/2009 | Dyer et al. | 482/54 |
| 7,645,213 | B2 | 1/2010 | Watterson et al. | |
| 7,981,000 | B2 | 7/2011 | Watterson et al. | |
| 8,047,966 | B2 | 11/2011 | Dorogusker et al. | |
| 8,480,541 | B1 * | 7/2013 | Brunts | 482/7 |
| 8,676,170 | B2 * | 3/2014 | Porrati et al. | 455/414.1 |
| 2009/0023556 | A1 * | 1/2009 | Daly et al. | 482/9 |

(Continued)

*Primary Examiner* — Oren Ginsberg
*Assistant Examiner* — Joshua Lee
(74) *Attorney, Agent, or Firm* — Maschoff Brennan

(57) ABSTRACT

A data collecting device is selectively attachable to a tread base of a treadmill. The device includes a foot fall sensing mechanism that collects foot fall data from the tread base, an inclination sensing mechanism that collects inclination data regarding the inclination of the tread base, and a communication mechanism that selectively transmits the foot fall data and the inclination data to an external computing device.

20 Claims, 6 Drawing Sheets

(56) References Cited

U.S. PATENT DOCUMENTS

2009/0105047 A1* 4/2009 Guidi et al. ..... 482/9
2010/0024531 A1* 2/2010 Senoo ..... A63B 24/0021 73/65.01
2010/0160115 A1* 6/2010 Morris et al. ..... 482/4
2010/0198453 A1* 8/2010 Dorogusker ..... A63B 24/0062 701/31.4
2010/0279822 A1* 11/2010 Ford ..... 482/8
2011/0059825 A1* 3/2011 McGown ..... 482/1
2012/0157265 A1* 6/2012 Kao ..... H04M 1/72527 482/9
2012/0209532 A1* 8/2012 Liang et al. ..... 702/19
2012/0252544 A1* 10/2012 Yuen ..... A61B 5/222 455/575.8
2012/0266648 A1* 10/2012 Berme et al. ..... 73/1.08
2013/0035215 A1* 2/2013 Ashby et al. ..... 482/54
2013/0127636 A1* 5/2013 Aryanpur ..... G08C 19/00 340/870.07
2013/0178334 A1* 7/2013 Brammer ..... 482/4
2013/0225370 A1* 8/2013 Flynt et al. ..... 482/4
2013/0289932 A1* 10/2013 Baechler ..... A61B 5/0002 702/141
2014/0074265 A1* 3/2014 Arginsky ..... A63B 24/0006 700/91
2014/0309085 A1* 10/2014 Watterson et al. ..... 482/9

* cited by examiner

SYSTEMS, METHODS, AND DEVICES FOR GATHERING AND TRANSMITTING EXERCISE RELATED DATA

CROSS-REFERENCE TO RELATED APPLICATIONS

This application claims priority to U.S. Provisional Patent Application No. 61/620,099 filed Apr. 4, 2012.

TECHNICAL FIELD

In general, the present invention relates to exercise devices and systems. More specifically, the present invention relates to a data collection device that can be selectively connected to an exercise device to collect exercise related data.

BACKGROUND

Stationary exercise devices have become an increasingly popular way to exercise. Over time, stationary exercise devices have evolved to include a wide variety of advanced features. For example, some exercise devices may communicate information to an external computing device. This information may include data regarding use of the exercise device. The external computing device may record and analyze the information. A user may access the exercise related data or other information on the external computing device in order to stay motivated by monitoring his or her progress. For example, U.S. Pat. No. 6,458,060, U.S. Pat. No. 7,060,006, U.S. Pat. No. 7,166,062, U.S. Pat. No. 7,455,622, U.S. Pat. No. 7,645,213, U.S. Pat. No. 7,981,000, and U.S. Pat. No. 8,047,966 disclose exercise devices that communicate exercise related data to separate computers or media players.

While newer exercise devices may come equipped with an internal feature that allows exercise related data to be transmitted to an external computing device, many earlier devices do not. Additionally, some advanced exercise devices may not be compatible with certain external computing devices. Thus, owners of older exercise devices who want to use an external computing device to track and view their progress may be required to record the data and enter it into an external computing device manually.

SUMMARY

In one embodiment, a data collecting device that is selectively attachable to a tread base of a treadmill includes a foot fall sensing mechanism that collects foot fall data from the tread base, an inclination sensing mechanism that collects inclination data regarding the inclination of the treadmill deck, and a communication mechanism that selectively transmits the foot fall data and the inclination data to an external computing device.

In another aspect that may be combined with any of the aspects herein, the foot fall sensing mechanism is an accelerometer.

In another aspect that may be combined with any of the aspects herein, the inclination sensing mechanism is a gyroscope.

In another aspect that may be combined with any of the aspects herein, the communication mechanism transmits the foot fall data and the inclination data to an external computing device via a wireless connection.

In another aspect that may be combined with any of the aspects herein, the communication mechanism comprises a Bluetooth transmitter.

In another aspect that may be combined with any of the aspects herein, the communication mechanism transmits the foot fall data and the inclination data to an external computing device intermittently during a workout session on the treadmill.

In another aspect that may be combined with any of the aspects herein, the communication mechanism transmits the foot fall data and the inclination data to an external computing device via a wired connection.

In another aspect that may be combined with any of the aspects herein, the communication mechanism comprises an Universal Serial Bus cable.

In another aspect that may be combined with any of the aspects herein, the data collecting device also includes a timer.

In another aspect that may be combined with any of the aspects herein, the timer begins to track elapsed time when a first foot fall is sensed.

In another aspect that may be combined with any of the aspects herein, the foot fall data includes a number of foot falls per unit of time.

In another aspect that may be combined with any of the aspects herein, the data collecting device also includes a memory that may store the foot fall data and the inclination data.

In another aspect that may be combined with any of the aspects herein, the data collecting device also includes software that converts the foot fall data into a speed or distance traveled.

In another aspect that may be combined with any of the aspects herein, the communication mechanism is configured to also receive data from an external computing device.

In another aspect that may be combined with any of the aspects herein, the data collecting device also includes a magnet that is selectively attachable to the treadmill deck.

In another aspect that may be combined with any of the aspects herein, a method tracks data regarding exercise performed on a treadmill and transmits the data to an external computing device.

In another aspect that may be combined with any of the aspects herein, the method includes selectively attaching a data collecting device to a treadmill tread base.

In another aspect that may be combined with any of the aspects herein, the method includes sensing foot falls of a user on the treadmill tread base with the data collecting device.

In another aspect that may be combined with any of the aspects herein, the method includes sensing the inclination of the treadmill tread base with the data collecting device.

In another aspect that may be combined with any of the aspects herein, the method includes transmitting data regarding the foot falls of the user and the inclination of the treadmill tread base from the data collecting device to an external computing device; and displaying exercise related data generated from the data regarding the foot falls of the user and the inclination of the treadmill tread base.

DETAILED DESCRIPTION

The present invention provides a data collecting device that may be secured to an exercise device. The data collecting device may gather information regarding use of the exercise device. This information may include data relating to foot falls, speed, pace, distance, incline, decline, and the like. The data collecting device may communicate the gathered information to be sent to an external computing device. The gathered information may be analyzed by either the external computing device or the data collecting device. The external computing device may make the information available to a user. Accordingly, as described in more detail hereafter, the data collecting device of the present invention may be used to gather and transmit data about the use of an exercise device. This device is especially useful with exercise devices that have limited data gathering and/or communicating capabilities or that are incompatible with certain external computing devices. Thus, the device of the present invention may in effect convert an exercise device that lacks certain data collecting and communicating features into one that is capable of tracking and transmitting data to an external computing device.

Figure 1:
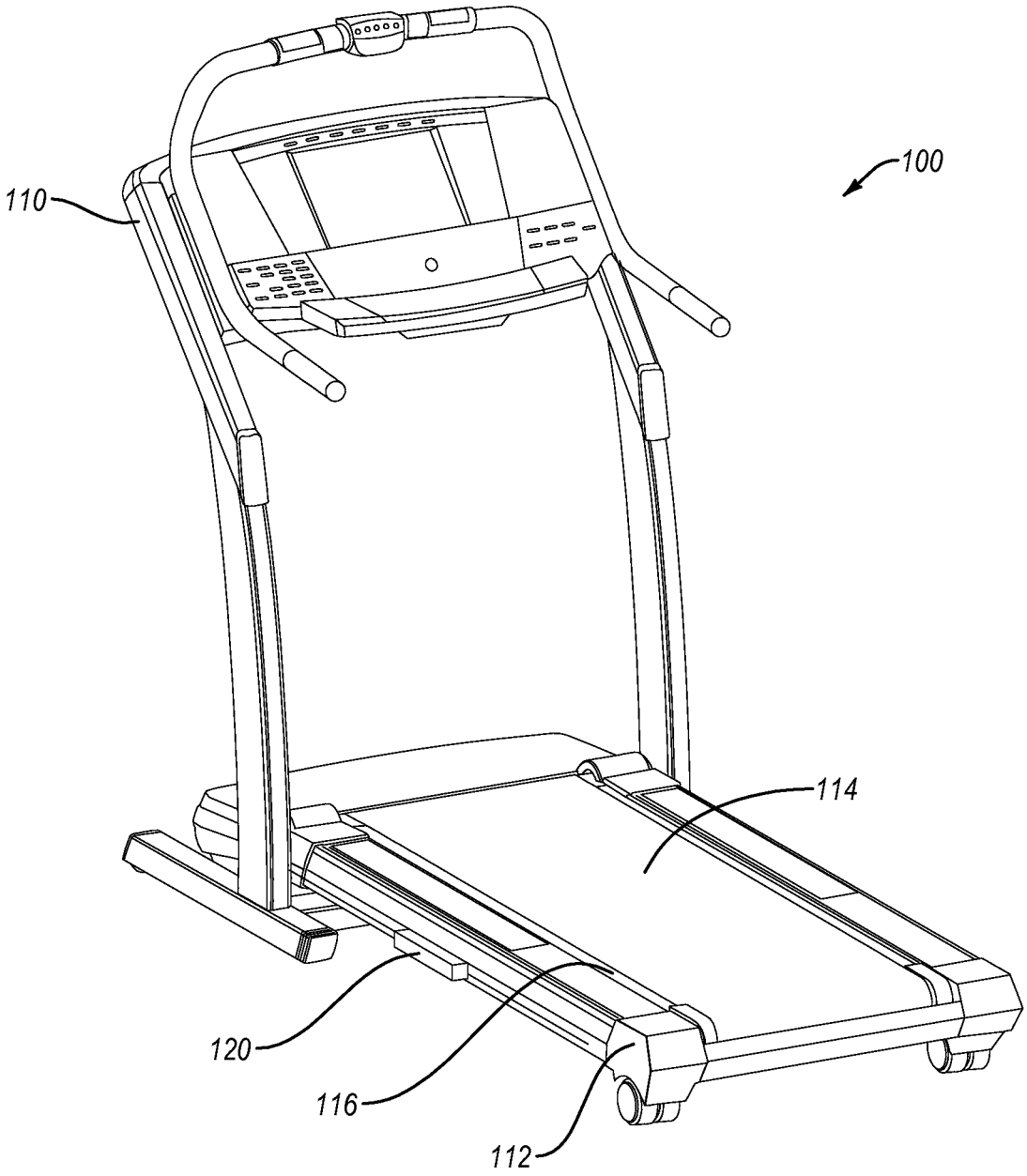
FIG. 1 illustrates a perspective view of an exercise system according to an example embodiment of the present invention.

FIG. 1 illustrates one example exercise system 100 according to the present invention. System 100 includes a treadmill 110 that has a tread base 112. Tread base 112 includes a belt 114 and a deck 116. Belt 114 includes an upwardly exposed section, which may be positioned above a deck 116 to provide a surface upon which a person using treadmill 110 may walk or run. The inclination level of tread base 112 may be selectively adjustable to simulate inclines and declines for a user performing an exercise thereon. For example, treadmill 110 may include a motor that raises and lowers one end of tread base 112.

System 100 also includes a data collecting device 120. Data collecting device 120 may be selectively attachable to treadmill 110. In the illustrated embodiment, data collecting device 120 is selectively attached to tread base 112. There are a number of different ways that data collecting device 120 may be selectively attached to tread base 112. For example, adhesives, such as glue or tape, one or more magnets, suction mechanisms, clamps, straps, hook and loop fasteners, or other devices may be used to selectively attach data collecting device 120 to tread base 112.

During the performance of an exercise on treadmill 110, information about the exercise may be gathered by data collecting device 120. As discussed in greater detail below, data collecting device 120 may include one or more sensors or other data gathering mechanisms (see FIG. 2B) that can detect exercise related information, such as a user's foot falls, speed, pace, distance, incline/decline of tread base 112, and the like. For instance, the one or more sensors may detect vibrations in tread base 112 that are created by the impact of a user's feet during each stride on treadmill 110.

Figure 2A:
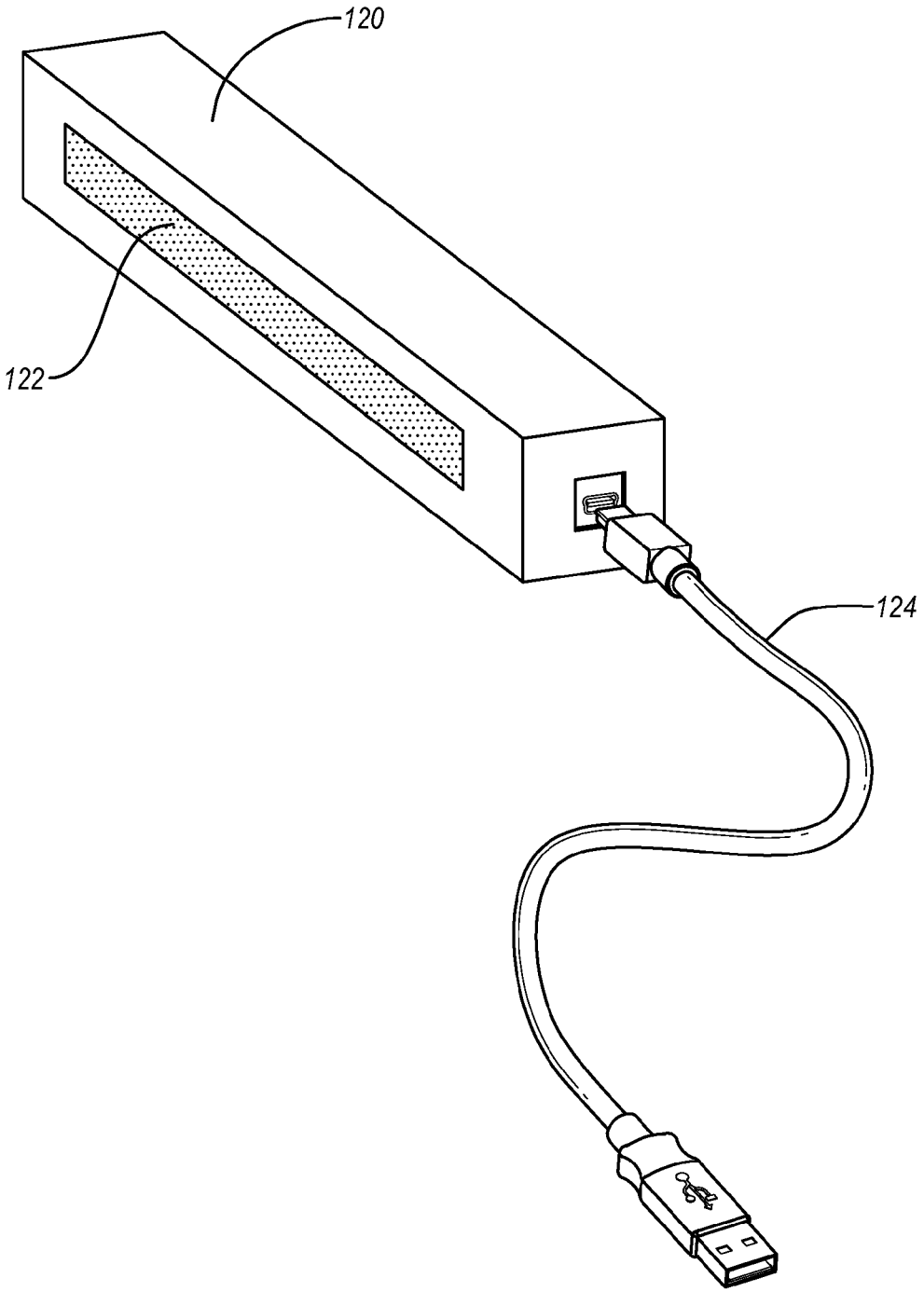
FIG. 2A illustrates a perspective view of data collecting device from the exercise system of FIG. 1.

FIG. 2A illustrates a perspective view of data collecting device 120 in which an attachment mechanism 122 can be seen. In the illustrated embodiment, attachment mechanism 122 is an elongated magnet that can be attached to a metal portion of treadmill 110. As discussed herein, data collecting device 120 may include one or more different sensors or structures that may collect data regarding the use of treadmill 110. Data collecting device 120 further includes a communication mechanism 124 that can transmit the collected data to an external computing device via a wired or wireless communication mechanism. For example, as can be seen in FIG. 2A, communication mechanism 124 is illustrated as a Universal Serial Bus (USB) cable, one end of which can be connected to data collecting device 120 and another end of which can be connected to an external computing device. A USB cable may be selectively engaged and disengaged from data collecting device 120 and/or an external computing device.

Figure 2B:
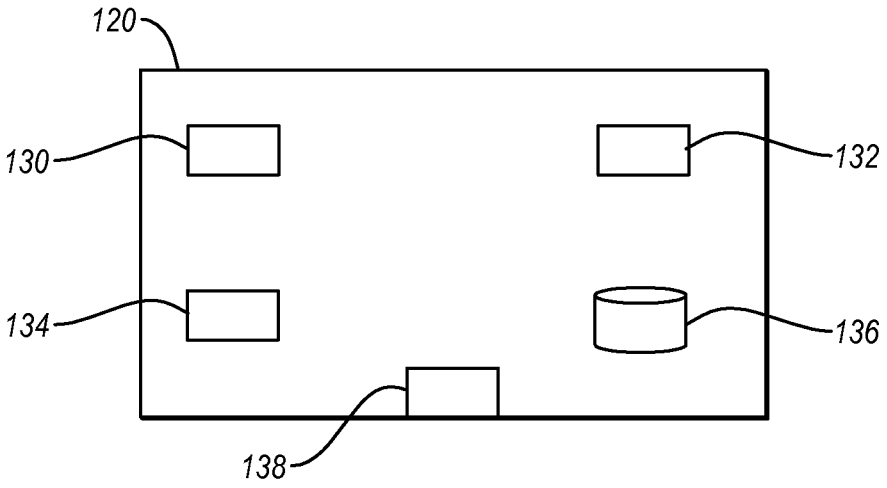
FIG. 2B illustrates a block diagram of the data collecting device of FIG. 2A.

FIG. 2B illustrates a block diagram of data collecting device 120. As can be seen in FIG. 2B, data collecting device 120 includes a foot fall sensing mechanism 130, a timer 132, an incline sensing mechanism 134, a memory 136, and a communication mechanism 138. With regard to data collecting device 120, communication mechanism 138 is a wired port to which a USB cable may be attached. Using foot fall sensing mechanism 130, timer 132, and incline sensing mechanism 134, data collecting device 120 may collect data including a user's foot falls, speed, pace, distance, incline/decline, and the like.

Figure 3:
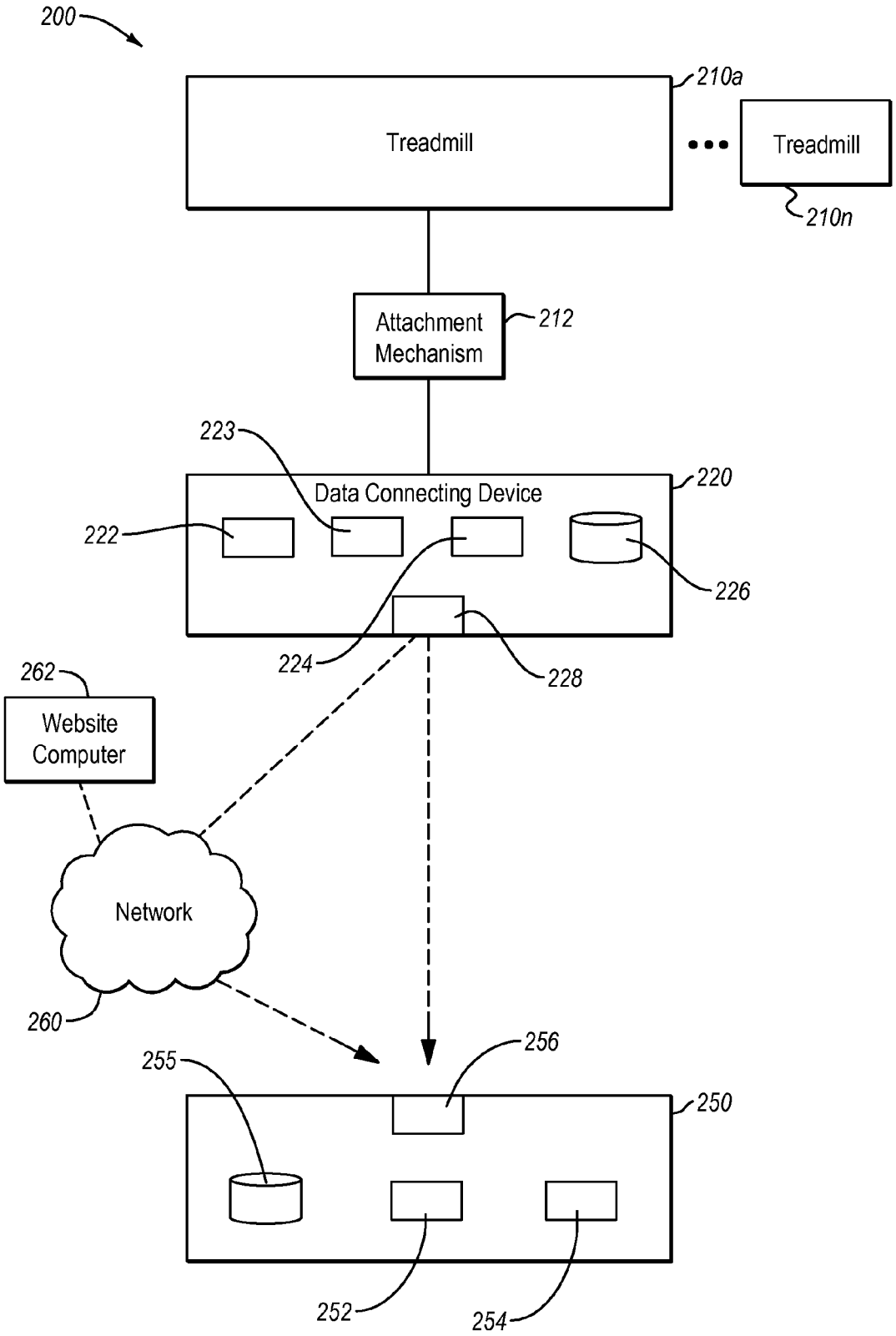
FIG. 3 illustrates a block diagram of an exercise system according to another example embodiment of the present invention.

FIG. 3 illustrates a block diagram of a second system 200 according to the present invention. System 200 includes treadmills 210*a*-210*n* and a data collecting device 220. Data collecting device 220 may be selectively attached to any of treadmills 210*a*-210*n* with an attachment mechanism 212.

Data collecting device 220 includes a foot fall sensing mechanism 222. Foot fall sensing mechanism 222 is designed to detect a user's foot falls during performance of an exercise on the treadmill 210*a*-210*n* to which data collecting device 220 in attached. Foot fall sensing mechanism 222 may comprise one or more load cells, piezo electric components (such as accelerometers), or other mechanisms that are capable of detecting foot falls.

Data collecting device 220 also includes a timer 223. Timer 223 may track the duration of an exercise session by tracking the amount of elapsed time during a workout session. To do so, timer 223 may begin tracking time when a first foot fall is sensed. Timer 223 may assume that a workout session is concluded when a specific amount of time has elapsed without any additional foot falls. For example, timer 223 may stop tracking time when no foot falls have been sensed for a period of five or ten seconds. Timer 223 may also be used to track the time between consecutive foot falls. This data may be used to determine the duration of a workout session and a user's foot fall rate.

Data collecting device 220 also includes an incline sensing mechanism 224. Incline sensing mechanism 224 may detect the tilt or inclination of the running surfaces, such as a tread base or running belt, on treadmills 210*a*-210*n* relative to horizontal. An inclination sensing mechanism 224 may comprise one or more inclinometers, gyroscopes, or other mechanisms that are capable of detecting inclines.

Data collecting device 220 may also include a memory 226. Memory 226 may be used to store data from foot fall sensing mechanism 222, timer 223, and inclination sensing mechanism 224. Memory 226 may comprise flash memory, RAM, ROM, EEPROM or any other medium which can be used to store data.

Data collecting device 220 further includes a wireless communication mechanism 228 that is able to wirelessly transmit data. In the illustrated embodiment, communication mechanism 228 is able to communicate the data to an external computing device 250, which in system 200 is a personal computer that includes a display screen 252, user input controls 254, and memory 255. External computing device 250 further includes a wireless receiver 256 that is able to receive data transmitted from communication mechanism 228. For example, communication mechanism 228 and receiver 256 may wirelessly communicate via a Bluetooth, Wi-Fi, radio frequency, or optical or another type of wireless communication linkage.

Communication mechanism 228 may transmit data directly to external computing device 250. Alternatively, communication mechanism 228 may transmit data to an external computing device 250 through a network 260. For example, communication mechanism 228 may transmit data to a website computer 262 via network 260, which may be accessed by external computing device 250 through network 260. Network 260 may be any type of network including but not limited to a wide area network, a local area network, and a telephone network. External computing device 250 may communicate with network 260 or website computer 262 via a wired or wireless communication connection.

Communication mechanism 228 may transmit data to external computing device 250 upon completion of an exercise session on one of treadmills 210*a*-210*n*. Data transmitted from data collecting device 220 to external computing device 250 may include data gathered from foot fall sensing mechanism 222, timer 223, and/or incline sensing mechanism 224. This data may comprise totals and averages based upon the complete exercise session. For example, this data may include the total number of foot falls that occurred during the workout session, an average rate of foot falls over the entire workout session, and the average inclination levels of the running surface during the workout session.

Alternatively, this data may include more specific information from different times during the workout session. For example, data collecting device 220 may take a "snapshot" of information every thirty seconds during the exercise session. This information may include the number of foot falls occurring during the previous thirty second period, an average rate of foot falls during the previous thirty second period, and the inclination level at the time of the snapshot. Thus, upon completion of a thirty minute workout, sixty different data sets may be sent for each thirty second interval. In this configuration, a user performing an exercise session on treadmill 210*a* that simulated a hill, the differing inclination levels of that hill could be seen from the snapshot data. This snapshot data may be stored on memory 226 until the completion of the exercise session or until the data is transmitted.

Alternatively, data may be transmitted from data collecting device 220 during an exercise session. For example, data collecting device 220 may be configured to transmit data intermittently (e.g., every ten seconds) and/or continuously. This data may include but is not limited to the duration of the workout, an instantaneous or average level of inclination, an instantaneous or average foot fall rate, and/or a total number of foot falls occurring during the exercise session up to the point of transmission. As with the snapshot data, data that is sent during a workout session may allow a user to see different inclination levels of simulated terrain. The data transmitted from data collecting device 220 to external computing device 250 may be displayed to a user on display screen 252 in a numerical, graphical, or other form. Display screen 252 may include video displays, liquid crystal displays (LCD), light emitting diodes (LEDs), cathode ray tube (CRT) displays, electroluminescent displays (ELD), gas-plasma displays, thin film transistor (TFT) displays, virtual reality (VR) displays, and the like.

The aforementioned transmitted data may also be used to determine additional data. For example, a user's total number of foot falls may be used in a calculation to determine speed and distance traveled. Specifically, a user's stride length, or the distance covered by one foot during one step, may be used to convert a total number of foot falls into speed and distance data. There are a number of different ways that information regarding a user's stride length may be obtained. For instance, a user's stride length may be estimated based on information including but not limited to the user's height, weight, inseam length, gender, and age. One or more of these pieces of information may be used to estimate a user's walking and/or running stride length. In one implementation, a person's height may be used to estimate his or her stride length. A person's stride length may be estimated to be approximately forty percent of his or her height. Using this estimation, the following Table 1 identifies equations that may be used to calculate distance and speed.

TABLE 1

| User Height (In) | Estimated Stride Length (In) | Distance (Mi) | Speed (Mi/Hr) |
|---|---|---|---|
| 67 | 26.8 | $\frac{26.8 * (\text{Total Foot Falls})}{63{,}360\ (\text{In/Mi})}$ | $\frac{\text{Distance (Mi)}}{\text{Hours Spent}}$ |
| 68 | 27.2 | $\frac{27.2 * (\text{Total Foot Falls})}{63{,}360\ (\text{In/Mi})}$ | $\frac{\text{Distance (Mi)}}{\text{Hours Spent}}$ |
| 69 | 27.6 | $\frac{27.6 * (\text{Total Foot Falls})}{63{,}360\ (\text{In/Mi})}$ | $\frac{\text{Distance (Mi)}}{\text{Hours Spent}}$ |
| 70 | 28 | $\frac{28 * (\text{Total Foot Falls})}{63{,}360\ (\text{In/Mi})}$ | $\frac{\text{Distance (Mi)}}{\text{Hours Spent}}$ |
| 71 | 28.4 | $\frac{28.4 * (\text{Total Foot Falls})}{63{,}360\ (\text{In/Mi})}$ | $\frac{\text{Distance (Mi)}}{\text{Hours Spent}}$ |
| 72 | 28.8 | $\frac{28.8 * (\text{Total Foot Falls})}{63{,}360\ (\text{In/Mi})}$ | $\frac{\text{Distance (Mi)}}{\text{Hours Spent}}$ |

While Table 1 uses only a person's height to estimate stride length, other factors including weight, inseam length, gender, and/or age may also have an impact on a person's stride length and may be taken into account in an equation for estimating stride length. In addition, a user's stride length may vary depending on the user's speed. For example, a user's stride length may be longer when the person is running and shorter when he or she is walking. Foot fall rate data may be used to determine whether a person is running or walking. For example, a faster foot fall rate may indicate running, and thus a longer stride length, while a slower foot fall rate may indicate walking, and thus a shorter stride length.

Distance and speed calculations may also be based on actual user stride length data. For example, a user may measure his or her stride length. Distance and speed can then be calculated based on the same equations identified in the above table. To ensure more accurate speed and distance determinations, a user may measure his or her stride length and foot fall rate while walking and again while running. Using this data a graph may be generated to calculate the user's stride length based on the user's foot fall rate.

Figure 4:
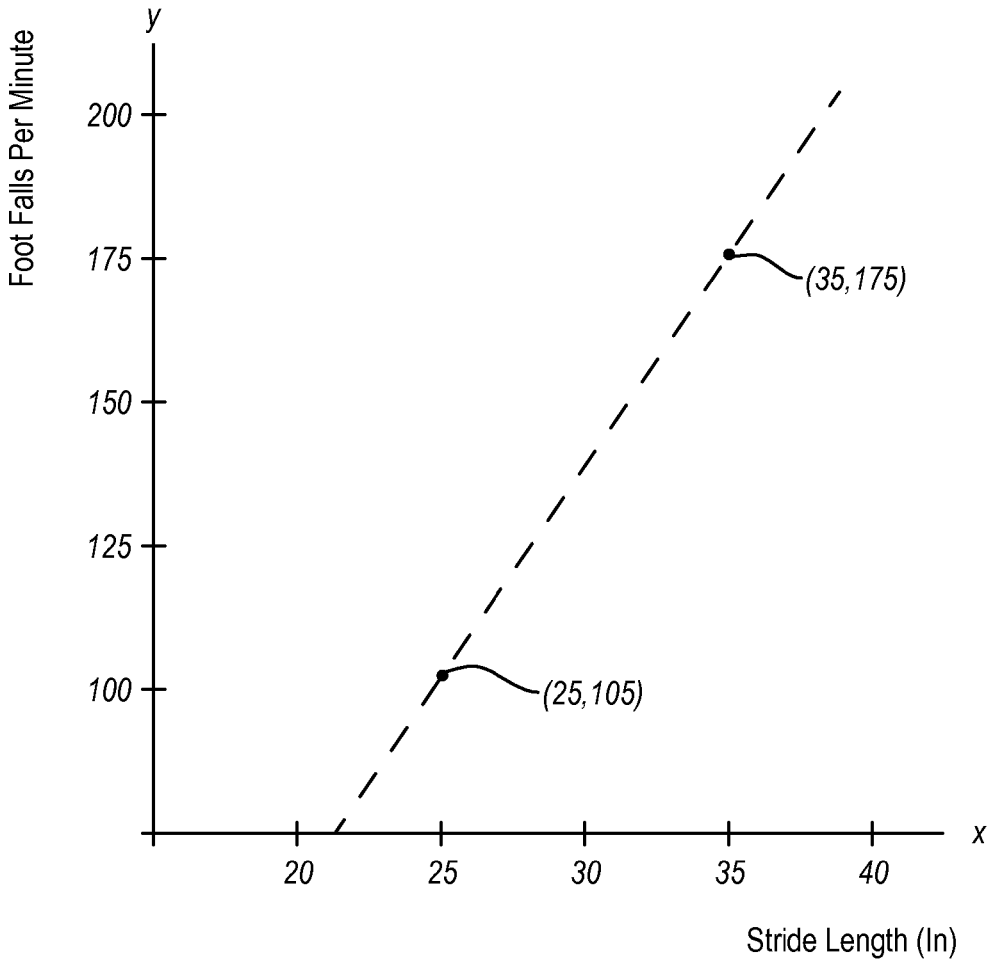
FIG. 4 illustrates a graph showing an example relationship between a person's stride length and foot fall rate.

For example, a person may have a walking stride length of twenty five inches and a walking foot fall rate of one hundred and five foot falls per minute. That person may also have a running stride length of thirty five inches and a running foot fall rate of one hundred and seventy five foot falls per minute. This data is used in FIG. 4 to create a graph that compares the relationship of this person's stride length in inches versus his or her foot falls per minute. As can be seen in FIG. 4, a linear relationship is assumed and the line connecting the walking and running data points can be expressed by the equation:

$$y=7(x)-70$$

where y is the number of foot falls per minute and x is the stride length. Using this equation, stride length, distance, and speed may be calculated using equations that account for differences in running and walking stride lengths according to the following Table 2:

TABLE 2

| Data | Equation |
|---|---|
| Stride Length (In) | $\frac{\text{Foot Falls Per Minute} + 70}{7}$ |
| Distance (Mi) | $\frac{\text{Stride Length (In)} * \text{(Total Foot Falls)}}{63{,}360\ \text{(In/Mi)}}$ |
| Speed (Mi/Hr) | $\frac{\text{Distance (Mi)}}{\text{Hours Spent}}$ |

Data collected from data collecting device 220 may also be used to calculate caloric expenditure totals and rates. One of ordinary skill in the art will appreciate that there are a number of different formulas for calculating caloric expenditure. For example, on a treadmill, caloric expenditure may be based on speed, inclination, user weight, and time spent exercising. Data collecting device 220 may collect data that may be used to identify speed according to the above equations. Data collecting device 220 may also collect data regarding inclination and time spent exercising. As with the additional data needed to calculate speed and distance, a user may input his or her weight. Using this data, caloric expenditure data may be calculated.

The aforementioned additional data, including a user's stride length, height, weight, inseam length, gender, and age, may be input in a number of different ways. For example, this data may be input using user input controls 254 on external computing device 250 or another computing device that is in communication with network 260. This data may be stored in memory 255 of external computing device 250. External computing device 250 may also include software that performs calculations to determine speed, distance, and caloric expenditure from data that has been input and data that has been received from data collecting device 220.

Alternatively, the additional data may be stored within the memory of website computer 262. Website computer 262 may also include the software that performs calculations to determine speed, distance, and caloric expenditure from data that has been input through external computing device 250 and data that has been received from data collecting device 220. In this embodiment, a user may access the exercise related data on website computer 262 through network 260.

Alternatively still, input data may be stored on memory 226 within data collecting device 220. For example, this data may be entered through external computing device 250 and transmitted to data collecting device 220 through communication mechanism 228. In this embodiment, the communication between communication mechanism 228 and wireless receiver 226 may be bidirectional such that data collecting device 220 may both transmit and receive data. Data collecting device 220 may further include the software that performs calculations to determine speed, distance, and caloric expenditure from data that has been received and the data collected from foot fall sensing mechanism 222, timer 223, and/or incline sensing mechanism 224. In this embodiment, data collecting device 220 may transmit at least stride length, distance, speed, and caloric expenditure data in addition to foot fall, workout duration, and inclination data.

Figure 5:
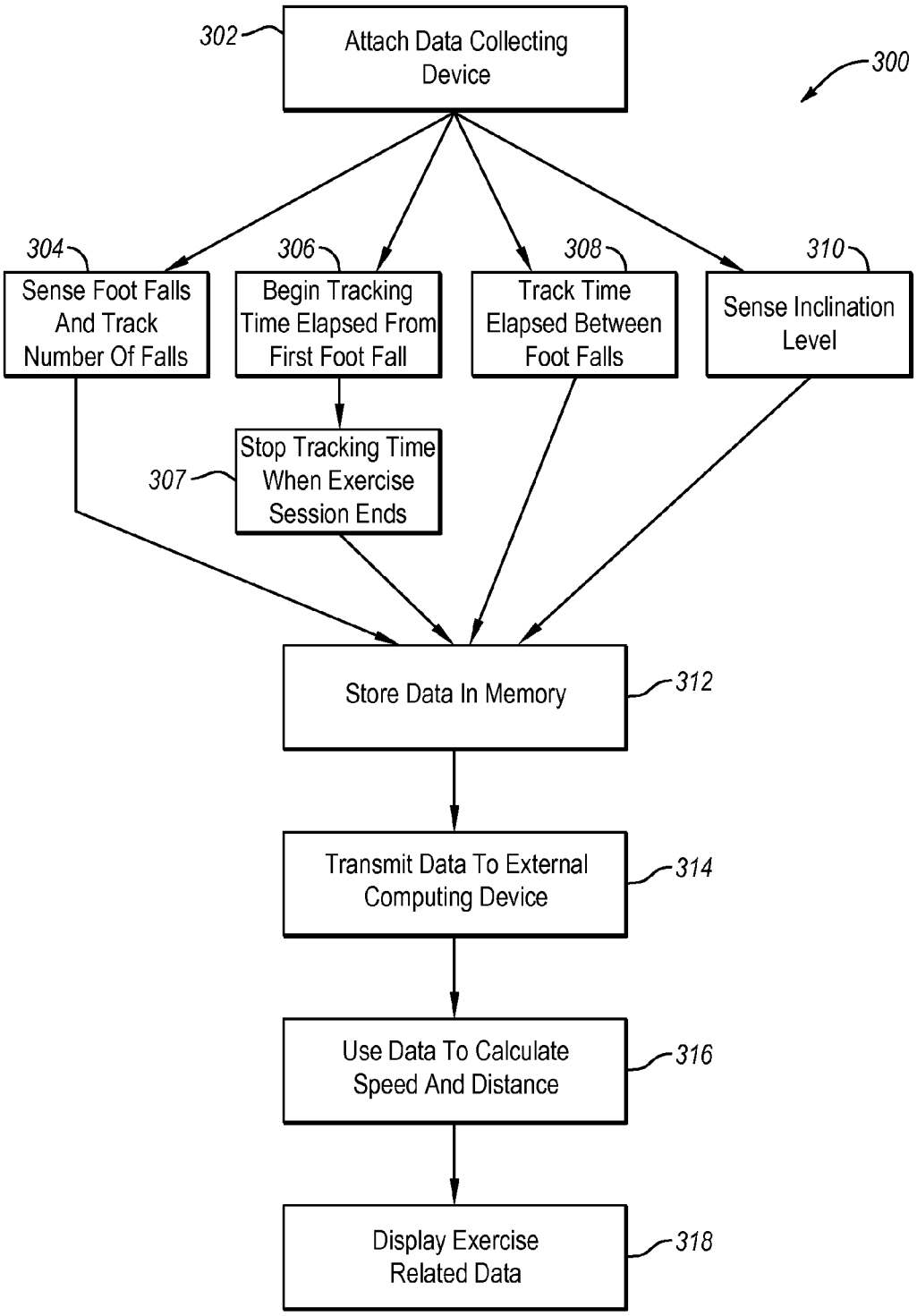
FIG. 5 illustrates a flow diagram of a method for collecting, transmitting, and displaying exercise related data.

FIG. 5 illustrates a flow diagram showing steps that may be implemented in a method 300 for collecting, transmitting, and displaying exercise related data from a treadmill. In a first step 302, a data collecting device is attached to a treadmill. For example, the data collecting device may be removably attached to the deck portion of the treadmill. In step 304, foot falls of a user performing an exercise on the treadmill are sensed and tracked. In a step 306, a timer within the data collecting device may identify the time of a workout session by beginning to track the amount of time elapsed beginning when a first foot fall is sensed. In step 307, the timer may be stopped when the exercise session ends. An exercise session may be determined to have ended based upon the passage of a certain amount of time without a subsequent foot fall. In step 308, the time between subsequent foot falls is tracked. In a step 310 an inclination level of the deck portion of a treadmill is sensed.

In a step 312, the information collected by the data collecting device, including data regarding number of foot falls, workout session time, time between foot falls, and inclination level, may be stored in a memory. In a step 314, this data may be transmitted from the data collecting device to an external computing device. This transmission may be via a wired or wireless connection. The transmission may be made directly to the external computing device, or indirectly, such as through a network. In a step 316, the data collected by the data collecting device is converted into speed, distance, and caloric expenditure data. Additional information, such as a user's height, weight, age, or stride length may be necessary to calculate speed, distance and caloric expenditure data. In some embodiments, step 316 is performed prior to step 314. Finally, in a step 318, exercise related data is displayed to a user. The exercise related data may include the data gathered by the data collecting device and/or the converted data.

INDUSTRIAL APPLICABILITY

In general, the present invention relates to a data collecting device that may be selectively attached to a treadmill. The data collecting device includes mechanisms that allow the device to gather data regarding the use of the treadmill to which the data collecting device is attached. The data collecting device can also communicate the gathered data to an external computing system so that a user may track his/her performance for a particular exercise session and/or over multiple exercise sessions. As a result, a data collecting device according to the present invention can transform a treadmill that lacks data collection and communication features into a treadmill that can communicate workout related data to any external computing device in communication with a network, like the Internet.

A data collecting device may include a foot fall sensing mechanism that may collect data regarding the number of foot falls during an exercise session. The data collecting device may include a timer that, based on the foot falls, identifies when a workout session has begun and when a workout session has ended. Thus, the timer may gather data regarding the duration of the workout session. The timer may also track time elapsed between foot falls. The data collecting device may further include an inclination sensing mechanism that may collect data regarding the inclination level of the treadmill tread base. The data collecting device also includes a communication mechanism that enables the data collected by the foot fall sensing mechanism, the timer, and the inclination sensing mechanism to be transmitted to an external computing device. The external computing device may record and track a user's workout sessions and provide the data in a displayable format.

The foot fall sensing mechanism may be any mechanism that is capable of sensing the foot falls on a treadmill. For example, the foot fall sensing mechanism may identify foot falls based on vibrations in the treadmill that are caused by a user's foot falls. The inclination sensing mechanism may be any mechanism that is capable of sensing the inclination level of a treadmill deck. The communication mechanism may be any mechanism that enables data to be transmitted from the data collecting device to an external computing device. For example, the communication mechanism may transmit data through a wired or wireless connection. Communication mechanism may transmit data directly to an external computing device or indirectly to an external computing device through a network. A network may include, for example, the internet.

A data collecting device may transmit data continuously or intermittently during an exercise program or at the end of the program. For example, the communication mechanism may be configured to transmit data wirelessly every sixty seconds to the external computing device. With this configuration, data snapshots throughout the entire workout session may be collected. For example, differing inclination levels or foot fall rates during the workout session may be noted. Even if the data collecting device does not transmit data periodically during the workout session, the data collecting device may take a snapshot during different times during a workout session and store this data in a memory within the data collecting device. When the data is transmitted, it will include data such as inclination level and foot fall rate from different times during the workout session. Alternatively still, the data collecting device may simply transmit a total number of foot falls and an average inclination level during the entire workout session.

A user may input additional information that may be used to convert the data gathered by the data collecting device into converted data. This additional data may include but is not limited to data regarding a user's running/walking stride length, running/walking foot fall rate, height, inseam, weight, age, and gender. Using this additional information, data that is collected from a data collecting device may be converted into speed, distance, caloric expenditure, and the like. For example, a person may measure his or her stride length and foot fall rate and various different speeds from a slow walk to a sprint. A linear or nonlinear graph could be constructed based on the data points and a very precise stride length could be determined based on the user's foot fall rate.

The additional data about the user may be input through an external computing device and stored within the memory on an external computing device. The external computing device may also include the software necessary to calculate speed, distance, and caloric expenditure. Alternatively, the additional data may be stored in memory within the data collecting device. The data collecting device may also include the software necessary to convert the collected data into converted data.

Securing a data collecting device to a treadmill enables a person to track his or her workout sessions without having to manually input workout related data. Additionally, if the data collecting device is removable from the treadmill, any treadmill may be used to track the person's workout related data. The components of the data collecting device may be incorporated into any number of different devices. For example, in one implementation, the data collecting device is a cellular telephone. A user may simply download and choose an app that detects foot falls and the inclination of a treadmill tread base. In this embodiment a telephone network may be used to transmit the data. The telephone may be placed on the treadmill deck and held in place with a magnet, case, strap or another type of mechanism.

The invention claimed is:

1. A data collecting device that is selectively attachable to a tread base of a treadmill, the data collecting device capable of converting the treadmill that lacks certain data collecting and communicating features into a treadmill that is capable of tracking and transmitting data to an external computing device, the data collecting device comprising:

a foot fall sensing mechanism that collects foot fall data from the tread base;

an inclination sensing mechanism that collects inclination data regarding the inclination of the tread base relative to horizontal; and a communication mechanism that selectively transmits the foot fall data and the inclination data to an external computing device;

wherein the foot fall sensing mechanism, the inclination sensing mechanism, and the communication mechanism are portable, hand-held electronic mechanisms that are selectively attachable to the treadmill, wherein the data collecting device is a cellular telephone.

2. The data collecting device of claim 1, wherein the foot fall sensing mechanism comprises an accelerometer.

3. The data collecting device of claim 1, wherein the inclination sensing mechanism comprises a gyroscope.

4. The data collecting device of claim 1, wherein the communication mechanism transmits the foot fall data and the inclination data to an external computing device via a wireless connection.

5. The data collecting device of claim 4, wherein the communication mechanism comprises a Bluetooth transmitter.

6. The data collecting device of claim 1, wherein the communication mechanism transmits the foot fall data and the inclination data to an external computing device intermittently during a workout session on the treadmill.

7. The data collecting device of claim 1, wherein the communication mechanism transmits the foot fall data and the inclination data to an external computing device via a wired connection.

8. The data collecting device of claim 7, wherein the communication mechanism comprises a Universal Serial Bus cable.

9. The data collecting device of claim 1, further comprising a timer.

10. The data collecting device of claim 9, wherein the timer begins to track elapsed time when a first foot fall is sensed.

11. The data collecting device of claim 9, wherein the foot fall data includes a number of foot falls per unit of time.

12. The data collecting device of claim 1, further comprising a memory that may store the foot fall data and the inclination data.

13. The data collecting device of claim 1, further comprising software that converts the foot fall data into a speed or distance traveled.

14. The data collecting device of claim 1, wherein data received by the communication mechanism includes at least one of a user stride length, a user height, a user weight, a user inseam length, a user gender, and a user age.

15. The data collecting device of claim 1, further comprising a magnet that is selectively attachable to the tread base.

16. A system for tracking and transmitting exercise related data comprising:

a treadmill having a tread base, the treadmill lacking certain data collecting and communicating features including a foot fall sensing mechanism and an inclination sensing mechanism; and a data collecting device selectively attachable to the treadmill to provide data collecting and transmission capabilities to the treadmill, the data collecting device comprising a foot fall sensing mechanism, an inclination sensing mechanism, and a communication mechanism, wherein the data collecting device may be selectively attached to the tread base;

wherein the foot fall sensing mechanism collects foot fall data from the treadmill base;

wherein the inclination sensing mechanism collects inclination data regarding the inclination of the tread base relative to horizontal;

wherein the communication mechanism selectively transmits the foot fall data and the inclination data to an external computing device; and wherein foot fall sensing mechanism, the inclination sensing mechanism, and the communication mechanism are portable, hand-held electronic mechanisms, wherein the data collecting device is a cellular telephone.

17. The system of claim 16, wherein the communication mechanism transmits the foot fall data and the inclination data to an external computing device via a wireless connection.

18. The data collecting device of claim 17, wherein the communication mechanism transmits the foot fall data and the inclination data to an external computing device intermittently during a workout session on the treadmill.

19. The system of claim 16, wherein the data collecting device is selectively attached to the tread base through a magnetic attraction.

20. A method for tracking data regarding exercise performed on a treadmill and transmitting the data to an external computing device, the treadmill being converted from a treadmill that does not collect data regarding foot falls of a user on a treadmill tread base or inclination of the treadmill tread base into a treadmill that is capable of collecting data regarding foot falls of a user on the treadmill tread base and inclination of the treadmill tread base and capable of transmitting the data to an external computing device, the method comprising:

selectively attaching a portable, hand-held data collecting device to a treadmill tread base of an existing treadmill;

sensing foot falls of a user on the treadmill tread base with the data collecting device;

sensing the inclination of the treadmill tread base relative to horizontal with the data collecting device;

transmitting data regarding the foot falls of the user and the inclination of the treadmill tread base from the data collecting device to an external computing device; and displaying exercise related data generated from the data regarding the foot falls of the user and the inclination of the treadmill tread base;

wherein the data collecting device receives data from an external computing device, wherein the data collecting device is a cellular telephone.

* * * * *